US006422787B1

(12) United States Patent
Mikell

(10) Patent No.: US 6,422,787 B1
(45) Date of Patent: Jul. 23, 2002

(54) SYNTHETIC BALE AND METHOD OF USING THE SAME FOR EROSION CONTROL

(76) Inventor: Mike Mikell, 5696 Reinke Dr., Crestview, FL (US) 32535

( * ) Notice: Subject to any disclaimer, the term of this patent is extended or adjusted under 35 U.S.C. 154(b) by 0 days.

(21) Appl. No.: 09/597,048

(22) Filed: Jun. 20, 2000

Related U.S. Application Data

(63) Continuation-in-part of application No. 09/405,320, filed on Sep. 24, 1999, now abandoned.

(51) Int. Cl.[7] ..... E02B 3/12
(52) U.S. Cl. ..... 405/15; 405/16
(58) Field of Search ..... 405/15, 16, 21, 405/258; 210/505, 508, 509, 496

(56) References Cited

U.S. PATENT DOCUMENTS

| | | | | |
|---|---|---|---|---|
| 3,847,719 A | * | 11/1974 | Crowley | 428/89 |
| 4,279,535 A | * | 7/1981 | Gagliardi et al. | 405/15 |
| 4,635,576 A | * | 1/1987 | Bowers | 405/16 X |
| 5,108,224 A | * | 4/1992 | Cabaniss et al. | 405/15 X |
| 5,201,497 A | * | 4/1993 | Williams et al. | 256/12.5 |
| 5,257,878 A | * | 11/1993 | Peterson | 405/15 |
| 5,595,458 A | | 1/1997 | Grabhorn | 405/258 |
| 5,605,541 A | | 2/1997 | Roach | 405/21 |
| 5,786,281 A | | 7/1998 | Prunty et al. | 442/104 |

FOREIGN PATENT DOCUMENTS

| | | | |
|---|---|---|---|
| JP | 58204224 | * | 5/1982 |
| JP | 6037333 | | 2/1985 |
| WO | 9638635 | * | 12/1996 |

OTHER PUBLICATIONS

Internet article "Thompson Culvert Company", Jul. 1998.*
"Needle punch Nonwoven Manufacturing" Mitch Chaplin, 1994 pp. 2.1–2.4.

* cited by examiner

*Primary Examiner*—David Bagnell
*Assistant Examiner*—Sunil Singh
(74) *Attorney, Agent, or Firm*—Peter Loffler

(57) ABSTRACT

A synthetic bale and method are used to control water flow, soil erosion, and sediment flow at a construction site. The synthetic bale is made from a sheet member formed from ground carpet fibers that are packed together. The sheet member is rolled up to form a body member and the body member is received within a cover, the cover being made from a mesh material. One or both ends of the cover are tied. The body member is secured to the ground by passing at least one stake through the cover and the body member and into the ground.

16 Claims, 6 Drawing Sheets

SYNTHETIC BALE AND METHOD OF USING THE SAME FOR EROSION CONTROL

This application is a Continuation-in-part of U.S. application Ser. No. 09/405,320 filed on Sep. 24, 1999, now abandoned.

BACKGROUND OF THE INVENTION

1. Field of the Invention

The present invention relates to a synthetic bale that controls water flow at construction areas.

2. Background of the Prior Art

At many construction sites including road work projects, it is necessary to control water flow, soil erosion and sediment flow through and around the construction area. The current method for such control is to secure one or more hay bales in and around the areas of desired control. While using a standard hay bale works generally well, the hay bale comes with many drawbacks.

The hay bale, by being a natural product, can come laden with weeds and other contaminates that can cause substantial environmental damage at the construction site. The hay bale is relatively heavy and bulky making installation and removal of the hay bales difficult. The hay bale has a relatively short life span and must be discarded after its useful life. During unusual climatic periods, hay may be in short supply and therefore difficult to get to a construction site.

Therefore, there is a need in the art for a system that controls water flow, soil erosion and sediment flow in and around a construction site that overcomes the above drawbacks. Such a system should not be a natural product that is capable of transporting weeds and other contaminants and introducing the contaminants to the construction site. The system should not be unusually heavy and bulky to handle and should not have a relatively short shelf-life. Ideally, such a system will have a use after its initial usefulness has run.

SUMMARY OF THE INVENTION

The synthetic bale and method of the present invention addresses the aforementioned needs in the art. The present invention provides water flow, erosion and sediment flow control at a construction site without undue drawbacks. The invention is an industrial product that has minimal risk of weed spread. The synthetic bale is not unduly heavy and is relatively easy to handle. The synthetic bale has a relatively long life span and can be recycled after its initial usefulness has run.

The synthetic bale and method comprise a water permeable sheet member that is rolled up, the sheet member being made from packed carpet fibers. The carpet is ground up into its original fiber size on the order of a couple of inches in length and these fibers are then formed into the sheet member 12. The sheet member is formed by any appropriate technique known in the art for producing such sheet members including needle punching (the fibers are formed into a batt and then introduced into a needle punch machine wherein the fibers are interlocked mechanically as the needles of the machine have spaced apart barbs thereon and the barbs, as the needles move up and down pickup the fibers and lock them together), stitch bonding (a batt is formed and then stitched in a linear or cross direction to hold the batt together), chemical bonding (a batt is formed and then held together by introducing a chemical solution such as latex Acrylic, or other binder), and thermal bonding (low melt fibers are introduced into the batt and then batt is heated causing the low melt fibers to melt to hold the batt together). The sheet member is secured to the ground by passing a stake therethrough. The sheet member is received within a cover, the cover being formed from an appropriate mesh material and one or both ends of the cover are tied or otherwise closed off. If multiple synthetic bales are positioned along a lateral axis, then one sheet member is partially received within the cover of any adjoining sheet member and vice versa.

BRIEF DESCRIPTION OF THE DRAWINGS

Similar reference numerals refer to similar parts throughout the several views of the drawings.

DESCRIPTION OF THE PREFERRED EMBODIMENT

Figure 1:
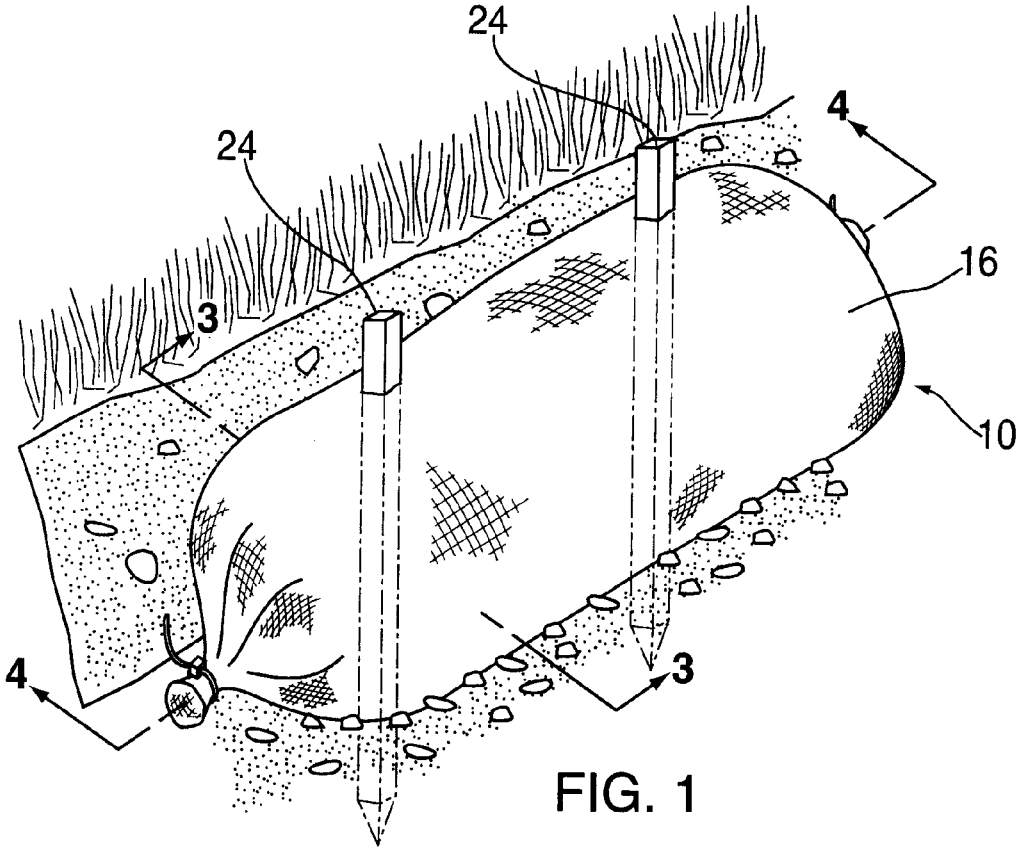
FIG. 1 is an environmental view of the synthetic bale of the present invention secured to the ground.
Figure 2:
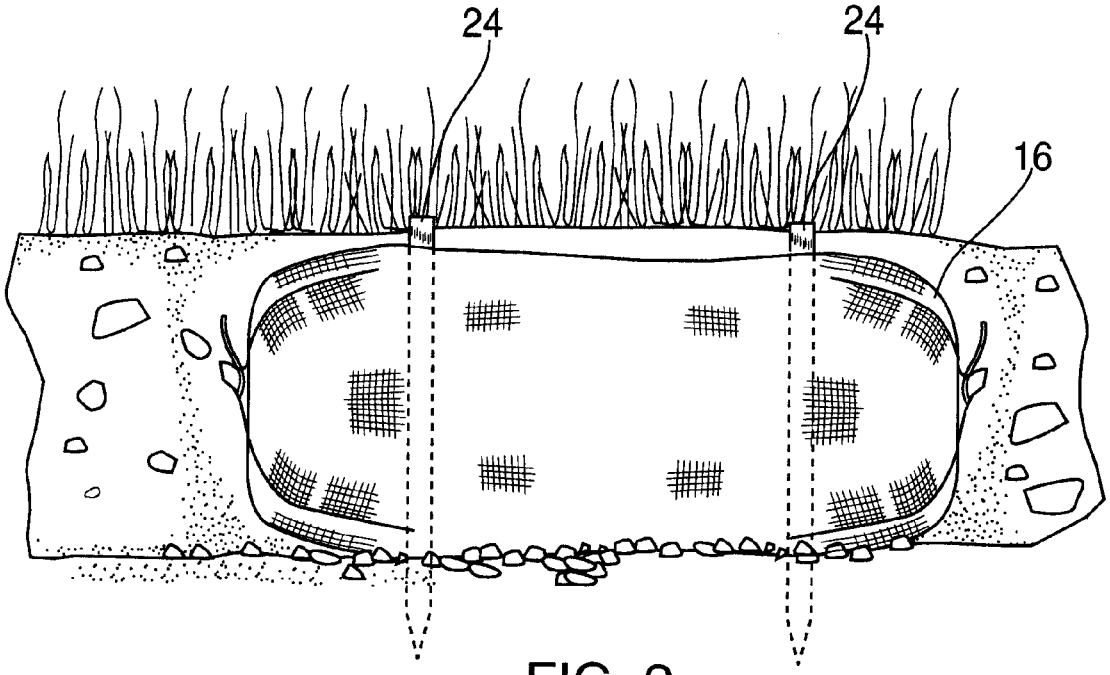
FIG. 2 is a front elevation view of the synthetic bale secured to the ground.

Referring now to the drawings, it is seen that the synthetic bale of the present invention, generally denoted by reference numeral 10, is comprised of a sheet member 12, the sheet member 12 being formed from ground and packed carpet fibers. The body member 14 is sufficiently porous to allow water to pass through the body member 14 but will have sufficient density to trap sediment and other debris. In order to achieve this balance, the body member 14 has a density of between about 0.5 pounds per cubic foot and about 15 pounds per cubic foot. A density below about 0.5 pounds per cubic foot is insufficient to capture the desired debris while a density above about 15 pounds per cubic foot is too dense to allow sufficient water flow through the body member 14.

Figure 3:
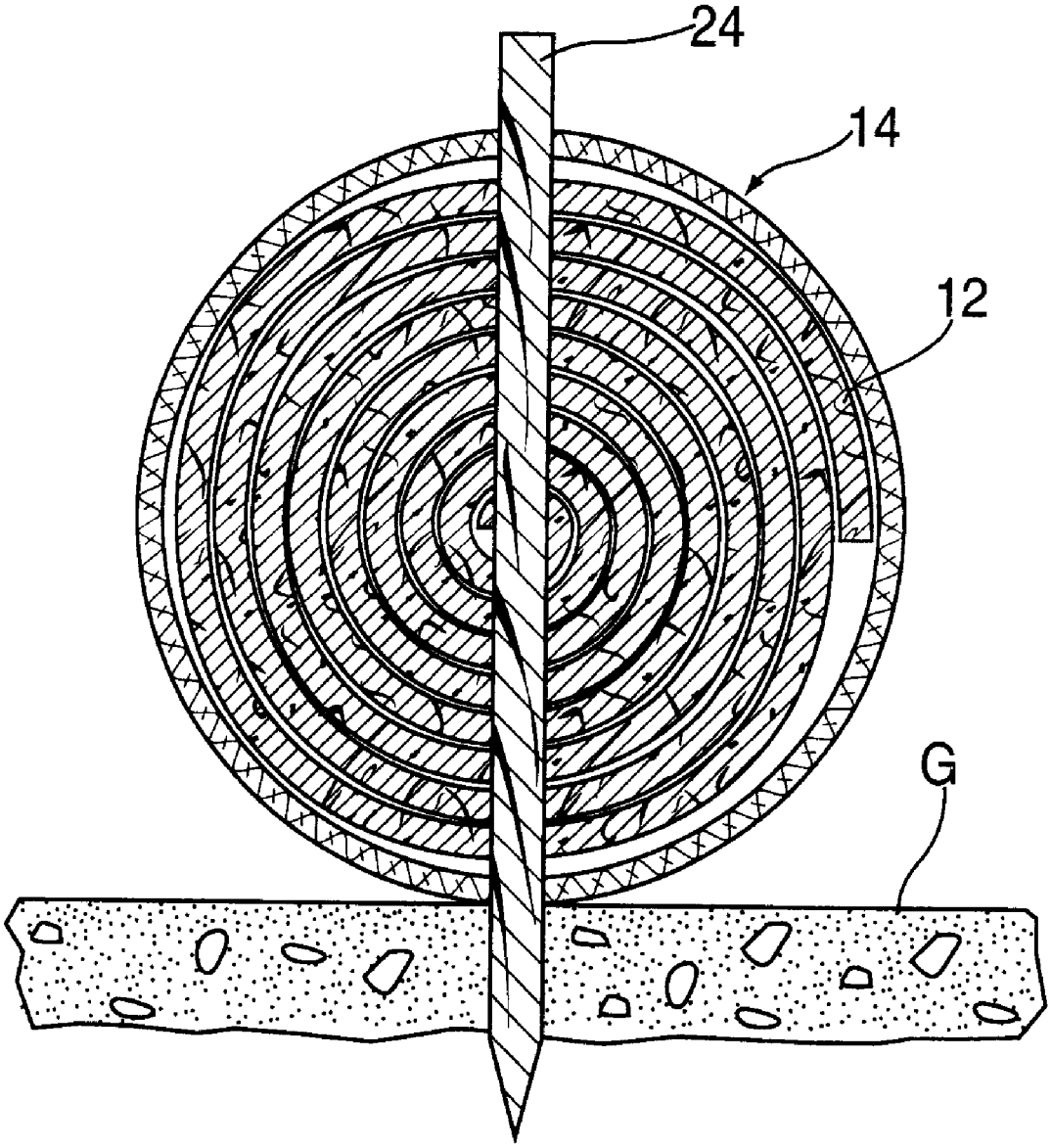
FIG. 3 is a side sectioned view of the synthetic bale secured to the ground taken along line 3—3 in FIG. 1.
Figure 4:
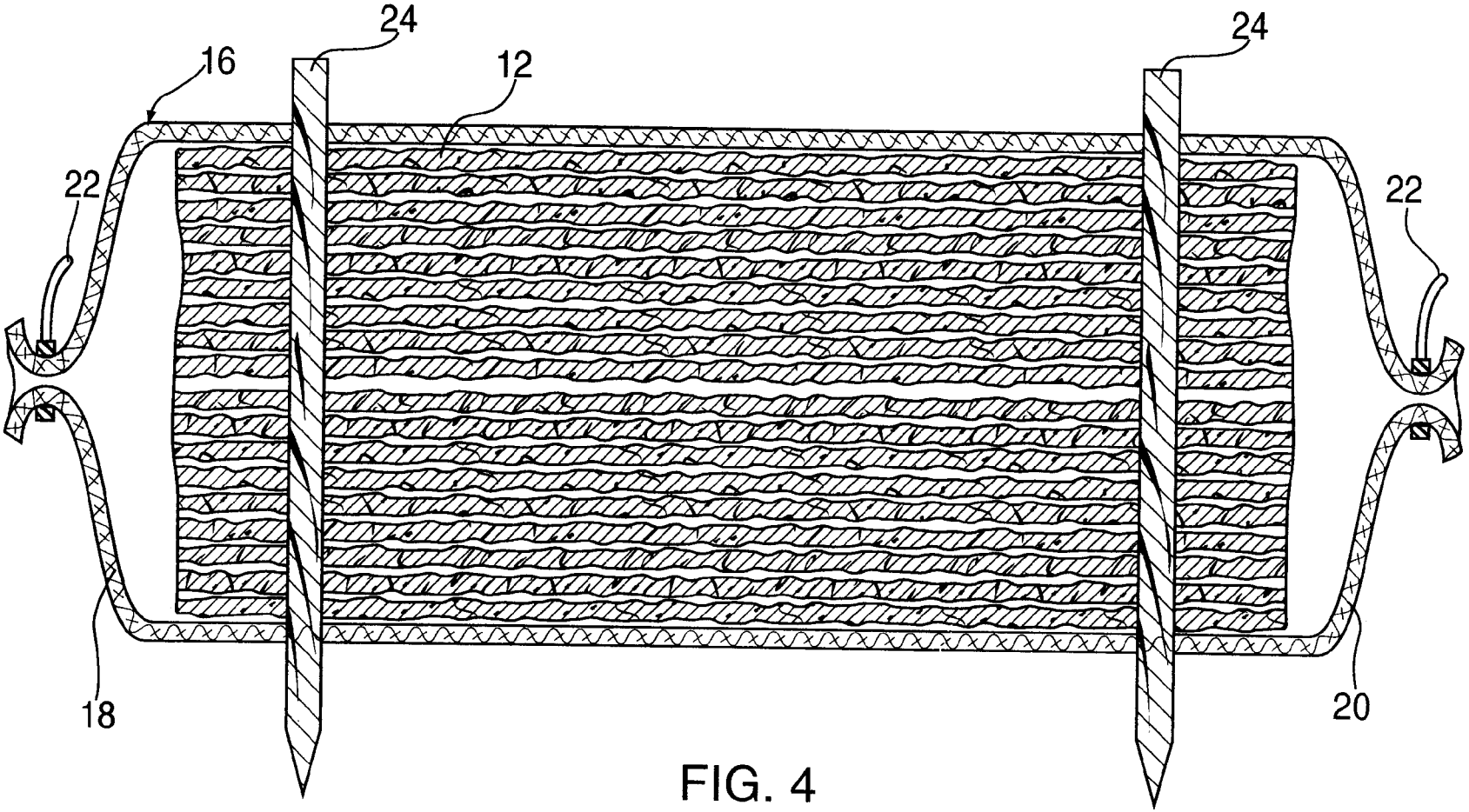
FIG. 4 is a front sectioned view of the synthetic bale secured to the ground along line 4—4 in FIG. 1.
Figure 5:
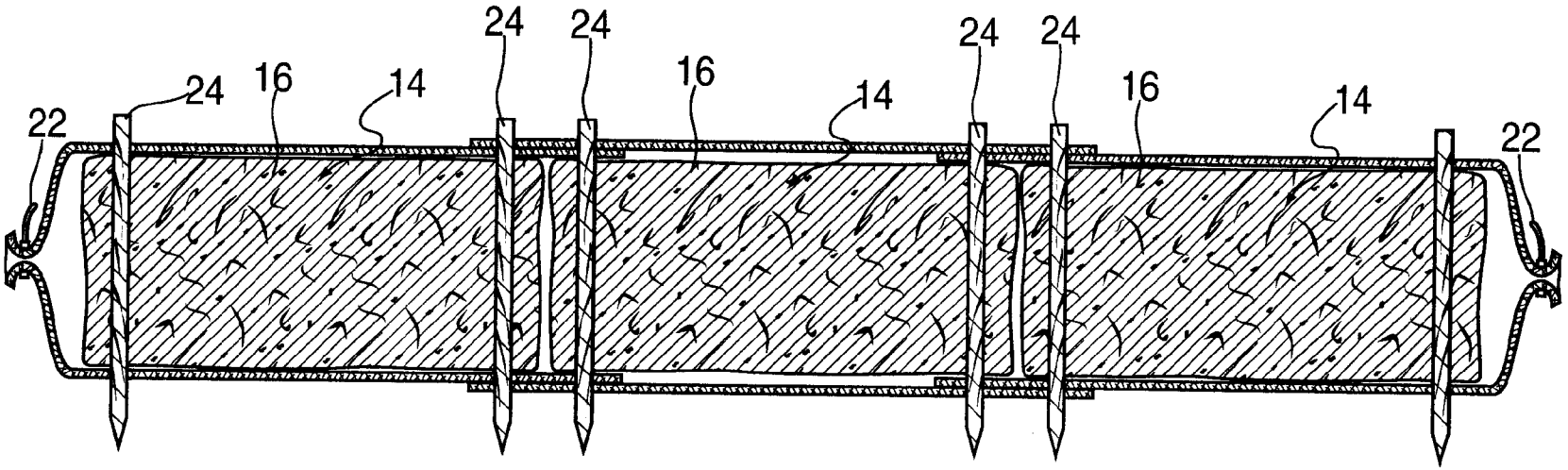
FIG. 5 is a front sectioned view of multiple synthetic bales of the present invention positioned along a lateral axis.
Figure 6A:
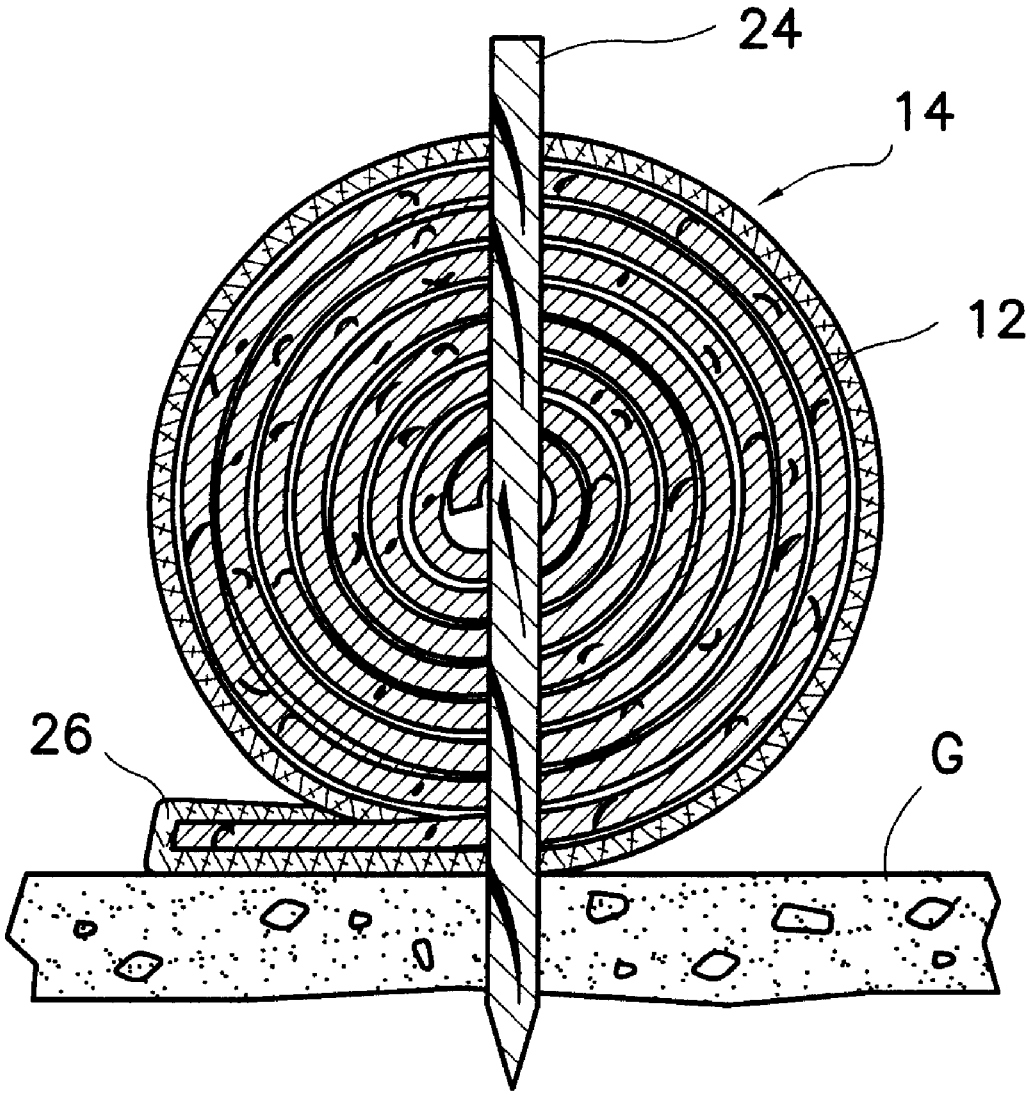
FIG. 6*a* is a side sectioned view of the synthetic bale having a tail running along the ground.
Figure 6B:
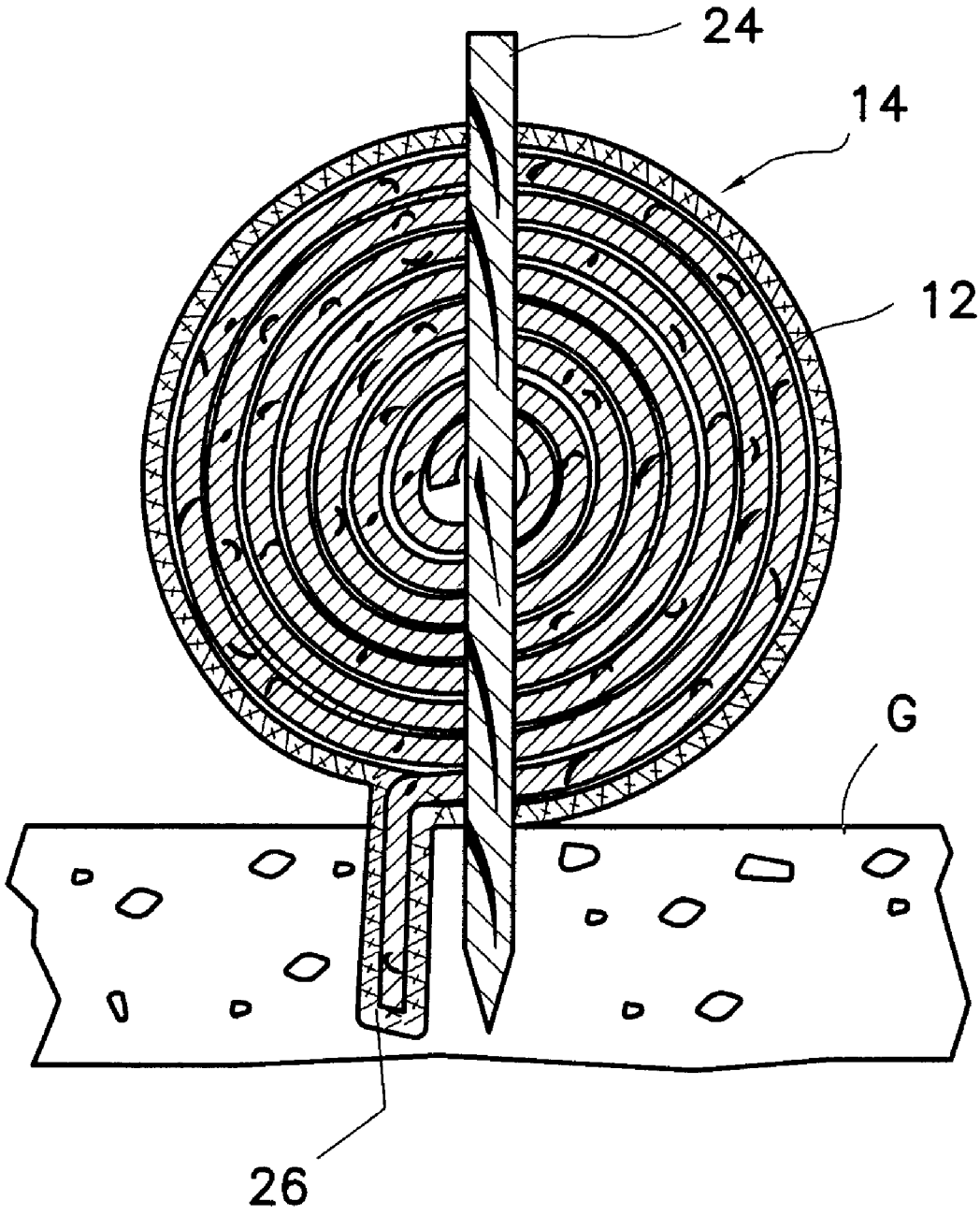
FIG. 6*b* is a side sectioned view of the synthetic bale having a tail received within the ground.

The sheet member 12 is rolled up to form a body member 14. The body member 14 is received within a cover 16, the cover 16 having a first end 18 and a second end 20, and being formed from an appropriate mesh material such as rope, nylon, etc. One or both ends 18 and 20 of the cover 16 are closed or otherwise tied. Tying of the ends 18 and 20 can be accomplished in any appropriate fashion such as tying the appropriate end of the cover 16 around itself or providing an appropriate tying material 22, the tying material being made from rope, flexible plastic, metal, etc. As best seen in FIG. 3, the body member 14 may be generally circular with the end of the sheet member 12 positioned generally flush against the body member 14, or as seen in FIGS. 6*a*–6*b*, the body member 14 may have a tail 26 that can either run along the ground G or that can be inserted into the ground G. If a cover 16 is used, an appropriate pocket is provided to receive the tail.

At least one stake 24 passes through the cover 16 and the body member 14. A hole can be pre-drilled into the body member 14 or the stake 24 can be driven into the body member by an appropriate method.

In order to use the synthetic bale 10 of the present invention, the synthetic bale 10 is positioned at the desired location and the at least one stake 22 is passed through the cover 16 and the body member 14 and into the ground G. If multiple synthetic bales 10 are to be positioned in side by side abutment along a lateral axis, the end 18 or 20 of the cover 16 that is next to another synthetic bale 10 is untied and the cover 16 of one synthetic bale 10 partially receives the adjoining synthetic bale 10 and vice versa. Water flows to the synthetic bale 10, and as the body member 14 is water permeable, the water passes through the body member 14. However, due to the packing of the carpet fibers used to make up the sheet member 12 and thus the body member 14, soil and sediments that are contained in the water are trapped by the body member 14, thereby controlling sediment flow and soil erosion. Once sufficient soil and sediment have been filtered by the device 10, the synthetic bale 10 may be hosed down or otherwise washed for reuse. Once the synthetic bale is no longer capable of adequate filtering, the body member 14 may be ground up, cleaned by an appropriate technique and rebuilt.

While the invention has been particularly shown and described with reference to an embodiment thereof, it will be appreciated by those skilled in the art that various changes in form and detail may be made without departing from the spirit and scope of the invention.

I claim:

1. A synthetic bale for securement to the ground in a water flow path comprising a body member through which water can flow, the body member being made from packed carpet fibers and having a density between about 0.5 pounds per cubic foot and about 15 pounds per cubic foot, the body member being a relatively flat sheet member that is rolled up and is fixedly secured to the ground in the rolled up state.

2. The synthetic bale as in claim 1 wherein the body member is secured to the ground by passing at least one stake through the body member.

3. The synthetic bale as in claim 1 further comprising a cover having a first end and a second end such that the body member is received within an interior of the cover.

4. The synthetic bale as in claim 3 wherein the first end is tied.

5. The synthetic bale as in claim 4 wherein the second end is tied.

6. The synthetic bale as in claim 3 wherein the body member is secured to the ground by passing at least one stake through the cover and the body member.

7. The synthetic bale as in claim 3 wherein the cover is made from a mesh material.

8. The synthetic bale as in claim 1 further comprising a tail that extends outwardly from the body member.

9. A method for water flow control comprising the step of:

providing a body member through which water can flow, the body member being made from packed carpet fibers and having a density between about 0.5 pounds per cubic foot and about 15 pounds per cubic foot, the body member being a relatively flat sheet member that is rolled up and is fixedly secured to the ground in the rolled up state; and fixedly securing the body member to the ground.

10. The method as in claim 9 wherein the body member is secured to the ground by passing at least one stake through the body member and into the ground.

11. The method as in claim 9 wherein the body member is received within a cover, the cover having a first end and a second end.

12. The method as in claim 11 wherein the first end is tied.

13. The method as in claim 12 wherein the second end is tied.

14. The method as in claim 11 wherein the body member is secured to the ground by passing at least one stake through the cover and through the body member and into the ground.

15. The method as in claim 11 wherein the cover is made from a mesh material.

16. The method as in claim 9 further comprising a tail that extends outwardly from the body member.

* * * * *